9/6/83 51 OR 4,402,219

United States Patent [19]

Hache

[11] 4,402,219

[45] Sep. 6, 1983

[54] APPARATUS FOR DETECTING THE STUCK POINT OF DRILL PIPES IN A BOREHOLE

[75] Inventor: Jean M. Hache, Bourg-la-Reine, France

[73] Assignee: Schlumberger Technology Corporation, Houston, Tex.

[21] Appl. No.: 333,153

[22] Filed: Dec. 21, 1981

[30] Foreign Application Priority Data

Dec. 31, 1980 [FR] France ..... 80 27868

[51] Int. Cl.[3] ..... E21B 47/00

[52] U.S. Cl. ..... 73/151

[58] Field of Search ..... 73/151; 166/66, 250, 166/255

[56] References Cited

U.S. PATENT DOCUMENTS 3,095,736 7/1963 Rogers ..... 73/151
3,686,943 8/1972 Smith ..... 73/151
3,994,163 11/1976 Rogers ..... 73/151
4,104,911 8/1978 Lavigne et al. ..... 73/151

*Primary Examiner*—Jerry W. Myracle

[57] ABSTRACT

The invention relates to apparatus for detecting the stuck point of a conduit, such as drill pipes, in a borehole while eliminating any stress on the detection means during the measurement. A two-part body member is suspended from a cable with the two parts (23 and 24) mounted movably with respect to each other. Each part is anchored independently in the drill pipes and movements between these parts are detected when stresses are applied to the drill pipes (11) from the surface. After anchoring, a spring, designed to bias the two parts of the body member toward each other, is disconnected from the top part of the body member. An angular detection means is mounted between a mobile sleeve and the top part of the body member. Before the measurement, the sleeve is uncoupled from the bottom part and reset in relation to the top part. During the measurement, the sleeve is blocked in the bottom part.

21 Claims, 5 Drawing Figures

FIG. 2A
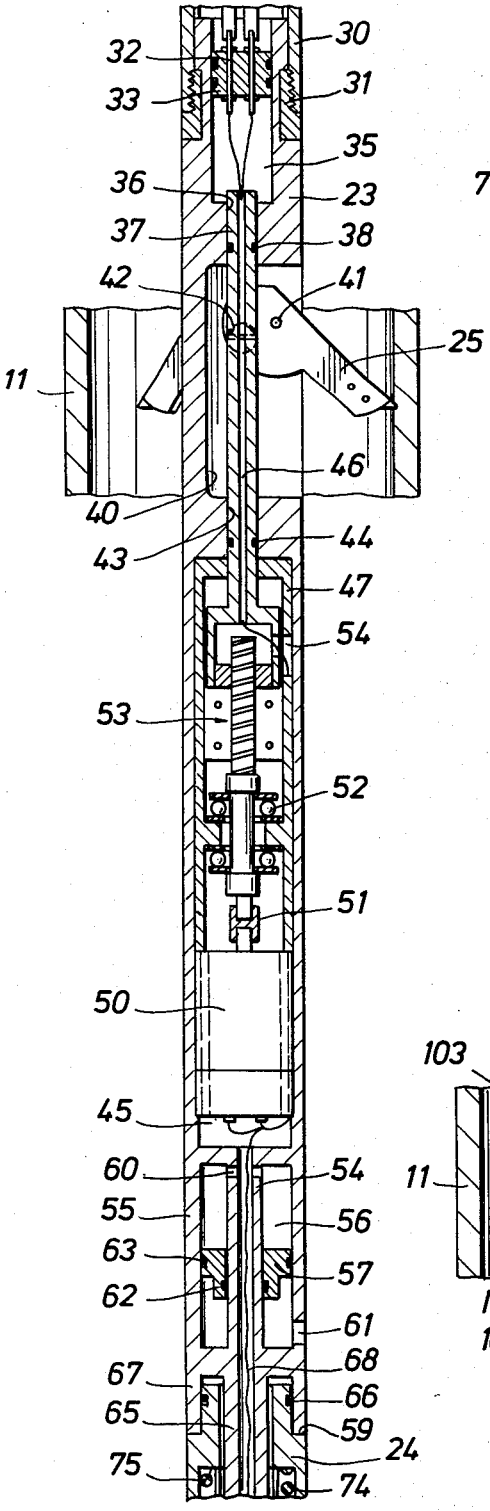
FIG. 2B
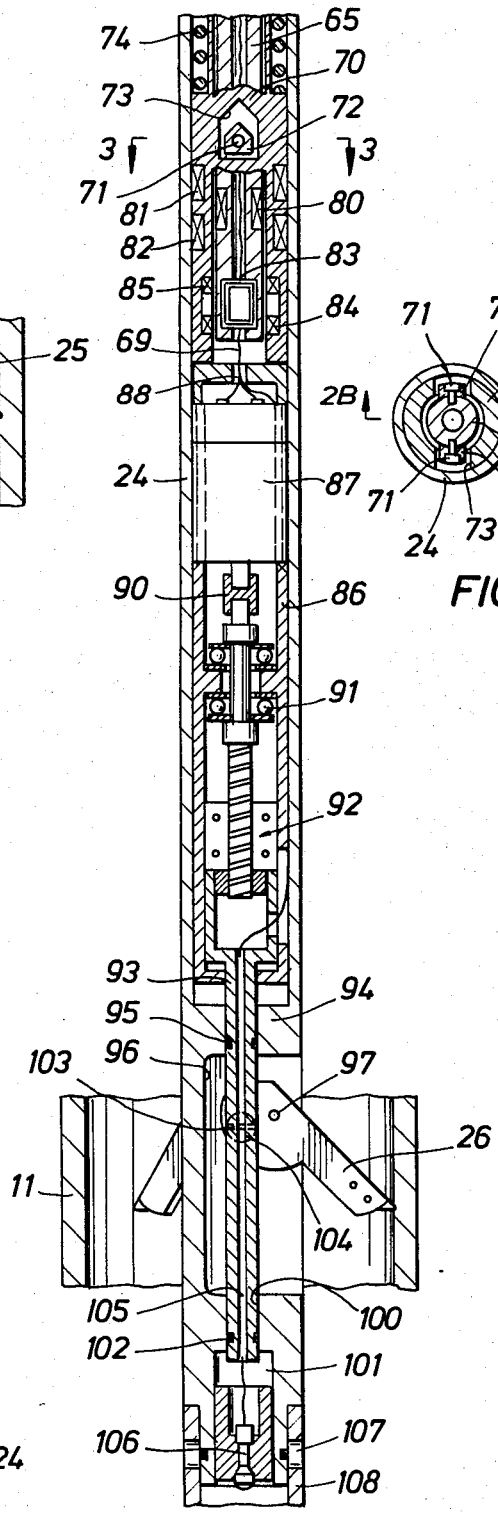
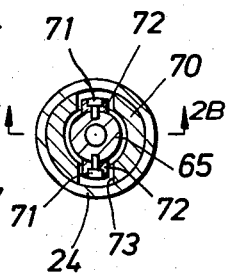
FIG. 3

APPARATUS FOR DETECTING THE STUCK POINT OF DRILL PIPES IN A BOREHOLE

BACKGROUND OF THE INVENTION

This invention relates to methods and apparatus for detecting the point at which a conduit is stuck in a borehole.

When a conduit, such as a drill string, is stuck in a borehole, a conventional method for determining the depth of the stuck point is to apply torsional and tensional deformations to the conduit from the surface and determine the depth to which the deformations are transmitted. A suitable apparatus is lowered into the conduit at the end of a cable and positioned at successive depths for detecting the deformations in the conduit.

A conventional stuck point detection apparatus, described for example in U.S. Pat. No. 3,686,943, comprises a body member having a top part and a bottom part mounted movably in relation to each other. Top and bottom anchoring elements mounted respectively over these top and bottom parts immobilize each of the parts of the body member in two longitudinally spaced zones of the conduit. Electric motors driven via the cable are used for moving the anchoring elements away from and toward the body member. Detection means mounted between the parts of the body member measure the relative movements between these parts when the conduit is deformed elastically by stresses applied from the surface.

An improved anchoring method, described in U.S. Pat. No. 4,104,911, consists first in anchoring the top part of the body member, and then, after releasing the tension on the cable, anchoring the bottom part. The advantage is that the moving parts of the body member are not placed in compression for the measurement. During this measurement, however, it is necessary for the two parts of the body member to be in a longitudinally contracted position to be able to move away from each other when tensions are applied to the drill pipes. For this purpose, the apparatus generally includes an elastic element or spring which applies a biasing force to the parts of the body member to load them toward each other. The drawback of such prior-art apparatus resides in the opposition of the return force to relative longitudinal extensions between the two parts of the body member during detection.

A first object of the invention therefore is to minimize such a longitudinal biasing force during the measurement.

For the detection of movements between the parts of the body member, it is advantageous to use a transducer such as described in U.S. patent application Ser. No. 258,218, filed Apr. 27, 1981 now U.S. Pat. No. 4,351,186 (assigned to the assignee of the present invention), which delivers two separate output signals, one independent of the rotations and the other independent of the longitudinal movements between the parts of the body member. This particular apparatus includes a resetting system which follows a complicated sequence of operations to place the detection means in an initial angular position before the measurement. In other known apparatus, the angular resetting system includes a spring or other elastic means, the return torque of which opposes rotation between the two parts of the body member during detection.

A second object of the invention is to provide an automatic angular resetting system not entailing a return torque during measurement.

Finally, customary resetting systems are generally driven by drive elements which are specific to them and controlled externally.

Another object of the invention is therefore to provide an apparatus whose resetting takes place automatically after anchoring the bottom part of the body member.

SUMMARY OF THE INVENTION

According to one aspect of the invention a method for detecting the stuck point of a conduit, such as drill pipes, in a borehole includes the steps of lowering a two-part apparatus into the conduit and anchoring each of these parts inside the conduit under surface control. The two parts of the apparatus are movably mounted with respect to each other and normally loaded or biased toward each other by a biasing force. After anchoring, the biasing force is uncoupled from the first part to eliminate the biasing force between these parts during the detecting step which follows. The method then further comprises detecting relative movements between the two parts of the apparatus body when the conduit is deformed by stresses applied from the surface.

The biasing force itself is applied through a linking means including a movable member coupled to the first part before the anchoring step but adapted to be uncoupled from the first part after the parts are anchored, thereby uncoupling the biasing force from this first part. The detecting means detects angular movements, inter alia, between the parts, and the method further includes maintaining the detecting means in a zero angular position while uncoupled from the second part of the body before the anchoring step, and coupling the angular detecting means to the second part after the anchoring step and before the detecting step, without substantially changing the zero position of the angular detecting means.

The apparatus itself more particularly includes a two-part body adapted to be suspended from a cable, the two parts being mounted for longitudinal and angular movement with respect to each other. Each part can be anchored inside the drill pipes under control from the surface, and means are provided to detect the relative longitudinal as well as angular movements between these parts when the drill pipes are deformed by tensile or torsional stresses applied from the surface.

The linking means member, which in the preferred embodiment is a sleeve, is mounted movably between a first position coupled to the first part of the body and a second position uncoupled from the first part. The biasing force is applied by a biasing means located between the second part and the sleeve. The biasing means loads this sleeve toward the first position and, through it, applies the return force between the first and second parts of the body. Driving means, placed in the second part of the body and, in the preferred embodiment, actuated after both body parts are anchored, moves the sleeve toward the second position to uncouple the sleeve from the first part.

The sleeve is blocked in relation to the second part of the body when in the second position, and uncoupled from the second part when in the first position. The angular detecting means is located on the sleeve and the first part of the body for sensing angular movements between these two elements. Resetting means includes oblique ramps which, under the action of the return means, zero the sleeve angularly in relation to the first part of the body when this sleeve is in the first position. A shoulder immobilizes the sleeve with respect to the second part when this sleeve is moved to the second position by the releasing means.

The longitudinal movement detection means, located on the sleeve and the first part of the body member, detects longitudinal movements between the first part and the sleeve. The aforementioned driving means anchors the bottom part of the body member in the drill pipes before moving the sleeve toward the second position.

BRIEF DESCRIPTION OF THE DRAWINGS

The characteristics and advantages of the invention will moreover better appear from the following description, given by way of nonlimitative example, with reference to the appended drawings, in which:

FIGS. 2A and 2B are longitudinal cross-sectional views of the downhole apparatus of FIG. 1, FIG. 2B being taken on line 2B—2B of FIG. 3;

FIG. 3 is a cross-sectional view taken on line 3—3 of FIG. 2B; and

DESCRIPTION OF THE PREFERRED EMBODIMENT

Figure 1:
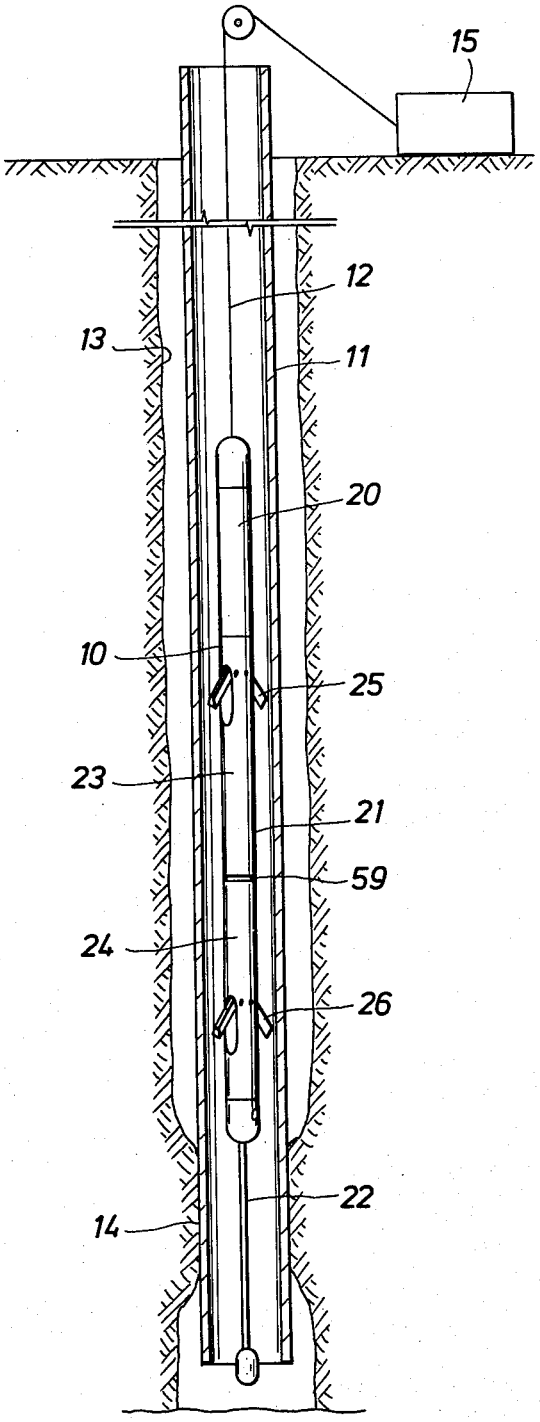
FIG. 1 is a somewhat figurative view of an apparatus according to the present invention disposed in its operational configuration for detecting the stuck point of a drill string in a borehole.

Referring to FIG. 1, a preferred embodiment of the stuck point detection apparatus according to the present invention comprises a downhole apparatus 10 suspended in a drill string 11 at the end of a cable 12. The drill pipes 11 placed in a borehole 13 are stuck by the earth formations at a point 14 whose depth is to be determined. The drill pipes are suspended at the surface in a known manner from a derrick (not shown) equipped with mechanisms making it possible to apply tensional and torsional forces to these drill pipes. The cable 12 has one or more electrical conductors connected to surface equipment 15. This equipment is adapted to send the downhole apparatus an electric power supply current and electric control signals and to receive, process, display, and record signals coming from the apparatus.

The downhole apparatus 10 comprises in general an electronic section 20 (usually a sealed casing containing electronic circuits) and a mechanical section 21. At the bottom of the mechanical section is a support 22 for receiving an explosive, such as several lengths of detonating cord designed to be ignited at the level of selected joint of the drill pipes. The resulting explosion helps unscrew all the drill pipes above the selected joint during a "back-off" operation, as is well known by those skilled in the art.

The mechanical section 21 includes a body made up of two parts 23 and 24 rotatably and slidably mounted for limited longitudinal and angular movements with respect to each other. The upper and lower parts are equipped with several anchoring arms 25 and 26, respectively. The anchoring arms are hinged on the body and can be extended under control from the surface to anchor the apparatus inside the drill pipes.

The mechanical section is shown in greater detail in FIGS. 2A and 2B. The sealed casing 30 of the electronic section 20 is fixed by a threaded bushing 31 at the body upper part 23. The electrical connections between the electronic and mechanical sections are provided by plug-in connectors 32 which go in a sealed and insulated manner through head 33 fixed in the body upper part 23. Inside the upper part 23 is a first chamber 35 under head 33. Chamber 35 is filled with a hydraulic fluid kept substantially at the pressure of the borehole, as further described below.

At the bottom of the chamber 35 is a bore 36 in which an actuating rod 37 equipped with an O-ring 38 is slidably mounted and sealed. The body part 23 has recesses 40 for receiving three anchoring arms 25 mounted rotably around pivots 41. A pin 42, which fits into a transverse groove of the actuating rod 37, is mounted rotatably on each anchoring arm 25 so that longitudinal movement of this rod makes the arms rotate around their respective pivots 41. The bottom of actuating rod 37 goes through a longitudinal bore 43 in the body part 23. With an O-ring 44 on rod 37 providing sealing at this region, the rod 37 then continues into a second chamber 45 which communicates with the first chamber 35 via a longitudinal passage 46 in the axis of the rod 37.

The second chamber 45 contains a case 47 which holds driving elements for moving the actuating rod 37 longitudinally. At the bottom of case 47 is an assembly 50 made up of an alternating-current motor and a reducer. The output shaft of the reducer is connected by an Oldham coupling 51 to a ball thrust bearing 52 and then to a ball screw 53. The nut element of the ball screw 53 is fixed to the enlarged lower end of the actuating rod 37. When current is supplied to the motor 50, the reducer output shaft rotates, driving the ball screw 53 which moves the actuating rod 37 longitudinally. The motor, under control from the surface, can rotate in either direction for opening or closing the anchoring arms 25.

Chamber 45 communicates with the inside of the case via a passage 54 so that the free spaces will be occupied by hydraulic fluid which bathes the motor 50, the thrust bearing 52, and the ball screw 53. Passages are provided between the case 47 and the body to conduct the wiring of the electrical conductors from the connectors 32 to the bottom of the chamber 45. At the bottom of chamber 45, the body thus includes an axial tube 54 whose interior communicates with chamber 45. At its periphery, the body also has a cylindrical wall 55 around the tube 54, thereby defining an annular chamber 56 in which slides a pressure-equalizing floating piston 57. Over the floating piston 57, the annular chamber 45, filled with hydraulic fluid, communicates with the interior of the tube 54 through a passage 60. The lower face of piston 57 is in contact with the borehole fluids through a passage 61. Sealing between the piston and the tube 54 is provided by a seal 62, and between the piston and the cylindrical wall 55 by a seal 63.

The body upper part 23 extends downward below the annular chamber 56 on a mandrel 65 which extends into the body lower part 24. A seal 66 provides sealing between part 24 and an annular end 67 of the upper part 23. The body lower part 24 can move away and rotate in relation to the shoulder 59 which terminates the annular end 67. The Mandrel 65 has an axial channel 68 which, connecting through the interior of tube 54, places chamber 45 in communication with another chamber 69 located in the body lower part 24. Channel 68 also serves as a passage for the electrical conductors.

Figure 4:
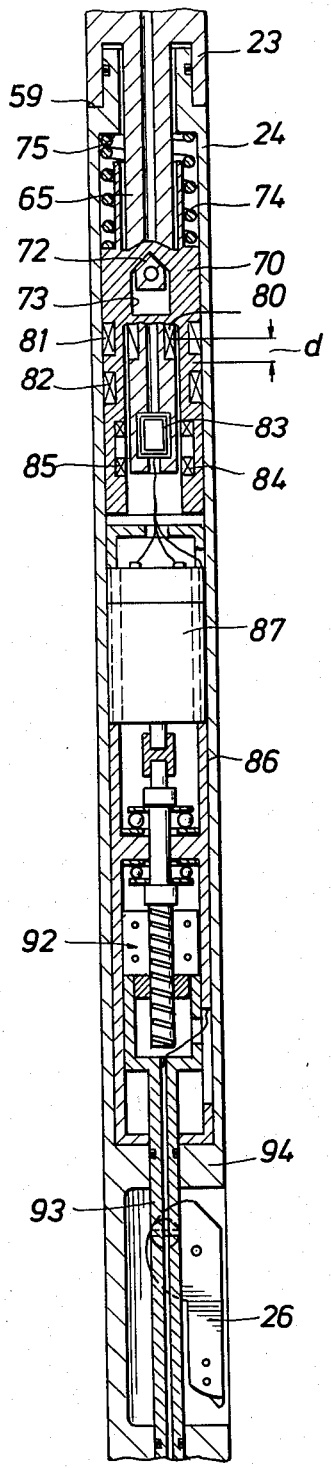
FIG. 4 is a longitudinal cross-sectional view similar to that of FIG. 2B, but in which the internal elements are positioned for lowering the apparatus into the borehole.

In the body lower part 24, and surrounding mandrel 65, is a sleeve 70 which is movably mounted between an upper position uncoupled from the upper part 23 (FIG. 2B) and a lower position uncoupled from the lower part 24 (FIG. 4). A disconnectable link 70, 72, and 73 connects the sleeve 70, in the lower position, to the body upper part 23. (The cross-section lines 3—3 and 2B—2B in FIGS. 2B and 3, respectively, are taken through this link.) Screws 71 fix diametrically opposite lugs 72 on the mandrel 65, the lugs having two sides parallel to the longitudinal direction and an upper edge in the form of an inverted V. Oppositely placed windows 73 having oblique ramps at their upper parts are cut in the sleeve 70. The lugs 72, positioned in the windows 73, are dimensioned to allow longitudinally and angularly limited movements of the mandrel 65 with respect to the sleeve 70 when the sleeve is in the upper position. The upward movement of the sleeve 70 is limited by its abutment with a shoulder 75 of the body lower part 24. The upper edges of the lugs 72 and of the windows 73 form ramps which both immobilize the sleeve 70 when it is moved downwardly and reposition it to a first position corresponding angularly to the zero of the angular detection means.

The sleeve 70 has an upper part of smaller diameter (FIG. 4) around which is placed a helical spring 74 mounted in compression between the sleeve 70 and the shoulder 75 on the body lower part 24. As indicated above, when the windows 73 come up against the top of the lugs 72 (FIG. 4), the sleeve 70 is zeroed and coupled, in the lower position, to the mandrel 65, and the spring 74 applies a biasing return force to the two parts 23 and 24 of the body which loads them toward each other. This force is sufficient to keep the two parts of the body in the retracted position (FIG. 4) when the apparatus is suspended by the cable 12 during raising and lowering within the borehole.

According to the present invention, the apparatus also includes means for detecting longitudinal and angular movements between the sleeve and the mandrel. These detection means, described in detail in the abovementioned '218 U.S. patent application, comprise two differential transformers. A first axial-coil transformer has a primary 80 fixed to tha mandrel, and a secondary, made up of two coils 81 and 82, fixed to the sleeve. This first transformer detects longitudinal movements between the parts of the body but is insensitive to angular movements. A second radial-coil transformer, having a primary 83 fixed to the mandrel and a secondary, made up of two coils 84 and 85 fixed to the sleeve, detects angular movements but is insensitive to longitudinal movements between the parts of the body. At the zero of the longitudinal detection means, the primary 80 of the firsti transformer is centered between the two coils 81 and 82 of the secondary (FIG. 2B). At the zero of the angular detection means, the primary 83 of the second transformer has its axis perpendicular to that of the coils 84 and 85 of the secondary. The sleeve and the mandrel are placed in this initial position prior to the measurement by the interaction of the lugs 72 and the windows 73.

A case 86 containing driving elements is mounted slidably in the body lower part 24 under the sleeve 70. The interior of the case communicates with chamber 69 via a passage 88. An assembly 87 consisting of an alternating-current electric motor and a reducer is fixed in case 86. The reducer output shaft 90, mounted rotatably in the case through a ball thrust bearing 91, is connected to the threaded shaft of a ball screw 92. The nut element of the ball screw 92 is fixed to an actuating rod 93 which comes out of the case 86 and goes through a transverse partition 94 of the body, downwardly closing off chamber 69 which is filled with hydraulic fluid. Sealing between the actuating rod 93 and the transverse partition 94 is provided by a seal 95. Underneath the transverse partition 94, the body has recesses 96 for three anchoring arms 26 which are articulated on pivots 97. Beneath the recesses 96, the actuating rod 93 passes through a bore 100 in the axis of the body and into a chamber 101. A seal 102 provides sealing in this region between the rod 93 and the body. Between the seals 95 and 102, the actuating rod has a triangular cross section with three transverse grooves 103. On each anchoring arm 26 a pin 104 is rotatably mounted, each pin having a projecting rib which engages in one of the grooves 103.

The motor-reducer assembly 87 can be supplied with electric current for moving the actuating rod 93 longitudinally either downwardly or upwardly in relation to the case 86. A longitudinal channel 105 cut in the actuating rod 93 provides communication between the chamber 69 and the chamber 101. An electrical conductor placed in the channel 105 is connected to an insulated and sealed connector 106 mounted at the bottom of the body lower part 24. Screws 107 fix the upper part 108 of the explosive support 22 on this end of body part 24. An electric detonator (not shown) for firing the explosive is connected to the connector 106.

To carry out a stuck point measurement, the downhole apparatus 10 is first connected to the cable 12 for lowering into the drill pipes 11. The upper and lower anchoring arms 25 and 26 respectively are closed and the different elements contained in the lower part of the body are in the position shown in FIG 4. In particular, the case 86 is in the lower abutting position against the transverse partition 94. The actuating rod 93, in the upper position in the case 86, keeps the lower anchoring arms 26 closed. The sleeve 70, driven back by the spring 74, is in the lower position, immobilized by the lugs 72 which are driven against the upper part of the windows 73. The angular movement detector (coils 83, 84 and 85) is thus placed in its zero angular position. Also, spring 74 applies an upward return force to the lower part of the body to keep the two parts 23 and 24 in the retracted position.

Apparatus 10 is then lowered into the borehole to a first depth where it is desired to determine whether the rods are free. At this depth, motor 50 (FIG. 2A) is supplied with current to extend the upper anchoring arms 25. After anchoring the body upper part 23, and after having released the tension from the cable 12, motor 87 is supplied with current. The lower anchoring arms then extend away from the body until they are in contact with the internal wall of the drill pipes 11. Case 86 rises slightly in the lower part of the body until it comes up against the bottom of the sleeve 70. At this point, the lateral application force of the anchoring arms 26 is determined by the longitudinal biasing or return force of the spring 74 transmitted via the sleeve 70 and the case 86 to the actuating rod 93. The anchoring arms 26, having reached their maximum extension in the drill pipes, stop the downward movement of the actuating rod 93 in relation to the lower part 24 of the body.

When the motor continues to rotate, the case 86 moves upward, driving the sleeve 70, which compresses spring 74. This movement continues until the upper end of sleeve 70 comes up against shoulder 75. Sleeve 70 is then blocked in the upper position in the lower part 24 of the body. During this movement, the oblique contact surfaces of the windows and of the lugs move away from each other, thereby disconnecting or uncoupling the link between the sleeve 70 and the mandrel 65. Sleeve 70, blocked at this point in the lower part 24 of the body, is free for limited movement angularly toward the right or the left and longitudinally in extension, relative to mandrel 65. This upper position of the sleeve, for which the angular and longitudinal detection means are substantially at zero, is shown in FIG. 2B. The apparatus is then ready to carry out a measurement, i.e. to detect movements between the parts of the body when tensile and torsional stresses are applied to the drill pipes from the surface.

After such a measurement, the motors 87 and 50 are supplied with current to close the lower and upper anchoring arms. It is then possible to move the downhole apparatus by means of the cable 12 to carry out other measurements at different depths.

During the movements of the apparatus in the borehole (FIG. 4), sleeve 70 is kept on the mandrel 65 in the lower position in which the angular movement detector is substantially at zero. However, in this position of the sleeve, the longitudinal movement detector indicates a maximum elongation, coil 80 being offset upwardly by a distance d in relation to the midpoint of the coils 81 and 82.

After anchoring the two parts of the body, sleeve 70 is brought to its upper position relative to mandrel 65, which position is not changed angularly in relation to the preceding lower position. For this upper position of sleeve 70, the longitudinal movement detector is substantially at zero, and sleeve 70, while still connected to the lower part of the body, is disconnected from the upper part. Thus, any biasing return force tending to oppose longitudinal or angular movements between the upper and lower parts of the body is eliminated during the measurement. Moreover, the indications given by the longitudinal movement detector during the anchoring of the apparatus make it possible to verify proper operation from the surface. When the detector indicates that the two body parts have moved toward each other from a value d to a substantially zero value, the operator knows that the sleeve 70 has moved correctly in the lower part of the body from its lower position to its upper position. Information is thus provided on the proper operation of the automatic resetting system of the apparatus.

The apparatus just described can of course form the subject of many variants without departing from the framework of the invention. In particular, the detection means can be made in a form different from the electromagnetic transducer described hereinabove.

I claim:

1. A method for detecting the stuck point of a conduit in a borehole comprising:

(a) lowering an apparatus in the conduit, the apparatus including a body having first and second parts movably mounted with respect to each other and normally biased toward each other by a biasing force, (b) anchoring each of the body parts inside the conduit under control from the surface, (c) detecting relative movements between the parts when the conduit is deformed by stresses applied from the surface, and (d) uncoupling the biasing force from the first part after said anchoring step and before said detecting step to eliminate the application of the force between the parts during said detecting step.

2. The method of claim 1 further comprising:

(a) applying the biasing force between the second part and a movable member adapted to be coupled to and uncoupled from the first part, and being coupled to the first part before the anchoring step, and (b) after said anchoring step, uncoupling the movable member from the first part to uncouple the biasing force from the first part.

3. The method of claim 2 further comprising:

(a) in said detecting step, detecting angular movements between the parts with a detecting means, (b) before said anchoring step, maintaining the detecting means in a zero position uncoupled from the second part of the body, and (c) coupling the detecting means to the second part after said anchoring step and before said detecting step, without substantially changing the zero position of the detecting means.

4. The method of claim 3 further comprising:

(a) detecting the relative movements between the first part of the body and the movable member while it is uncoupled from the second part of the body before said anchoring step, (b) before said anchoring step, maintaining the member in the zero position with respect to the first part, and (c) after said anchoring step, blocking the member to the second part of the body while uncoupling the member from the first part, and detecting the movements between the parts of the body with the detecting means.

5. A method for detecting the stuck point of a conduit in a borehole comprising:

(a) lowering an apparatus in the borehole, the apparatus including a body having first and second parts movably mounted with respect to each other, and detecting means for detecting at least the relative angular movements between the body parts, (b) anchoring each of the parts inside the conduit under control from the surface, (c) before the anchoring step, maintaining the detecting means in a zero position uncoupled from the second part of the body, (d) after said anchoring step, coupling the detecting means to the second part without substantially changing the zero position of the detecting means, and (e) after said coupling step, detecting relative movements between the parts when the conduit is deformed by stresses applied from the surface.

6. Apparatus for detecting the stuck point of a conduit in a borehole, comprising:

(a) a body adapted to be suspended from a cable and having two parts movably mounted with respect to each other, each part being adapted to be anchored inside the conduit under surface control, (b) means for detecting relative movements between said body parts when the conduit is deformed by stresses applied from the surface, (c) biasing means in said body for normally applying a longitudinal biasing force to said body parts which loads them toward each other, (d) disconnectable linking means for linking said biasing means longitudinally to a first of said body parts to cause the biasing force to be applied to said first part, and (e) driving means in said body for uncoupling said linking means from said first body part when said parts are anchored inside the conduit to eliminate application of the biasing force to said first part when detecting relative movements between said parts.

7. Apparatus according to claim 6 wherein:

(a) said linking means comprises a member movably mounted between a first position coupled to said first body part and a second position uncoupled from said first part, and (b) said biasing means is placed between said second body part and said member to load said member toward said first position and apply said biasing force between said first and second parts when said member is in said first position.

8. The apparatus of claim 7 wherein said driving means is placed in said second body part for moving said member toward said second position to uncouple said member from said first part.

9. The apparatus of claim 8 further comprising:

(a) means for uncoupling said means from said second part when in said first position and for blocking said member in relation to said second part when in said second position, and (b) means for placing said detecting means on said member and said first part of said body so as to be sensitive to movements between said member and said first part.

10. The apparatus of claim 9 wherein:

(a) said detecting means comprises means for detecting angular movements between said member and said first part, and (b) said apparatus further comprises resetting means for angularly zeroing said angular detecting means by placing said member in a corresponding zero position in relation to said first part when said member is in said first position.

11. Apparatus for detecting the stuck point of a conduit in a borehole comprising:

(a) a body adapted to be suspended from a cable and having first and second parts movably mounted with respect to each other, each part being adapted to be anchored inside the conduit under surface control, (b) means for detecting relative movements between said parts, (c) a member movably mounted in said body between a first position uncoupled from said second body part and a second position blocked in relation to said second part, (d) said detecting means including means for detecting angular movements between said member and said first body part, (e) resetting means for zeroing said angular detecting means by placing said member in a corresponding zero position with respect to said first part when said member is in said first position, and (f) driving means for moving said member from said first to said second position after said body parts are anchored inside the conduit, to block said member with respect to said second part and disconnect said resetting means without substantially changing the zero position of said detecting means.

12. The apparatus of claim 11 further comprising biasing means mounted between said member and said second body part for biasing said member toward said first position.

13. The apparatus of claim 12 wherein said member is coupled to said first body part when in said first position and uncoupled frm said first part when in said second position, said biasing means being mounted between said member and said second body part in order to apply a biasing force between said parts of the body when said member is in said first position, and said biasing force being uncoupled from said first part when said member is in said second position.

14. The apparatus of claim 10, 11, 12, or 13 wherein said resetting means comprises contact surfaces located between said member and said first body part, at least one of said contact surfaces having oblique ramps for placing said member under the action of said biasing means when in said zero position in relation to said first body part.

15. The apparatus of claim 14 further comprising a shoulder placed in said second body part such that said driving means immobilizes said member against said shoulder in said second position.

16. The apparatus of claim 15 wherein said angular movement detecting means comprises a radial-coil transformer having primary and secondary windings fixed respectively to said first body part and said member.

17. The apparatus of claim 15 wherein said detecting means further comprises means for detecting longitudinal movements between said first part and said member to indicate movements of said member produced by said driving means.

18. The apparatus of claim 17 wherein said longitudinal movement detecting means comprises an axial-coil transformer having primary and secondary windings fixed respectively to said first body part and said member.

19. The apparatus of claim 8, 9, 10, 11, 12 or 13 wherein said driving means is adapted to anchor the lower part of said body in the conduit before moving said member toward said second position.

20. The apparatus of claim 19 wherein said driving means comprises first and second actuating elements movably mounted in said second body part to extend longitudinally from each other, said first actuating element being connected to actuate the anchoring of said second part of said body inside the conduit, and said second actuating element being adapted to move said member from said first position to said second.

21. The apparatus of claim 8, 9, 10, 11, 12, or 13 wherein said first and second body parts are, respectively, the upper and lower parts of the body, and said driving means is adapted to move said member after the anchoring of the lower part of said body.

* * * * *